United States Patent [19]

Skees

[11] Patent Number: 4,940,690

[45] Date of Patent: Jul. 10, 1990

[54] CLEAN RELEASE LAMINATE CONSTRUCTION WITH LATENT IMAGE

[75] Inventor: Hugh B. Skees, Dayton, Ohio

[73] Assignee: The Standard Register Company, Dayton, Ohio

[21] Appl. No.: 224,691

[22] Filed: Jul. 27, 1988

[51] Int. Cl.[5] ..... B41M 5/16; B41M 5/22

[52] U.S. Cl. ..... 503/206; 427/152; 428/29; 428/41; 428/42; 428/195; 428/914; 428/915; 428/916; 503/226

[58] Field of Search ..... 428/29, 914–916, 428/41, 42, 195; 503/205, 226, 206, 215; 427/150–152

[56] References Cited

U.S. PATENT DOCUMENTS

| | | | |
|---|---|---|---|
| 3,383,121 | 5/1968 | Singer | 282/28 |
| 3,565,463 | 2/1971 | Taylor | 283/10 |
| 4,029,341 | 6/1977 | Neill et al. | 282/22 R |
| 4,109,047 | 8/1978 | Fredrickson | 428/916 |
| 4,204,706 | 5/1980 | Blum et al. | 283/21 |
| 4,250,216 | 2/1981 | Janssen | 428/78 |
| 4,277,089 | 7/1981 | Lockhart | 282/27 R |
| 4,347,274 | 8/1982 | Janssen | 428/78 |
| 4,479,838 | 10/1984 | Dunsirn et al. | 156/247 |
| 4,654,251 | 3/1987 | Okada et al. | 428/202 |
| 4,747,619 | 5/1988 | Sager | 282/9 R |

*Primary Examiner*—Bruce H. Hess

*Attorney, Agent, or Firm*—Killworth, Gottman, Hagan & Schaeff

[57] ABSTRACT

The present invention provides a laminate construction including a backing sheet, which may be in the form of a continuous web, and a face sheet covering at least a portion of the backing sheet. A releasable adhesive secures a first or lower surface of the face sheet to a first or upper surface of the backing sheet such that the face sheet and backing sheet are readily separable. The releasable adhesive contains therein a first composition which, when subjected to an imaging force, forms a latent image on both of the first surfaces of the face and backing sheets. This latent image may be developed at a later time by contacting the image with a second composition which, when exposed to the first composition, forms a visible image. In the laminate, the face sheet may be imprinted with legible and/or covert information. The covert information may be duplicated on the underside of the face sheet or on one or more intermediate sheets as well as a backing sheet. The face sheet can then be readily peeled from the construction and be used as a label, tag, form, or the like. The underlying sheets retain the same information as the face sheet. The covert or latent information can be developed at a later time to produce a visible image. All elements of the construction have nontacky surfaces, permitting easy handling and storage.

23 Claims, 2 Drawing Sheets

CLEAN RELEASE LAMINATE CONSTRUCTION WITH LATENT IMAGE

BACKGROUND OF THE INVENTION

This invention relates to a clean release laminate construction upon which a latent image may be formed, and in particular to a construction in which a releasable adhesive secures together two or more sheets upon which latent images may be formed through the use of chemical carbonless techniques.

Numerous types of businesses produce a wide variety of labels, nameplates, identification cards, tags, forms, and the like in larqe quantities. Each such product typically has specific indicia printed thereon by high speed printing devices. It is desirable to produce such products on a continuous web, with individual labels forms, or the like being adhesively attached to the web.

Additionally, manufacturers of quality products desire a procedure for permitting them to inspect samples of products and to determine quickly whether the sample is genuine or not. Many consumer goods are counterfeited and distributed with phony labels or tags. In many instances, it would be desirable to be able to have information on the label or tag of the product, such as clothing or other consumer goods, which will enable the manufacturer to identify the item and which contains information which will permit it to be tracked to its source.

Further, certain important documents are subject to counterfeiting. For example, checks, money orders, automobile titles and registration forms, birth certificates, or any other document which has value in itself or identifies another product of value may be a counterfeit. Accordingly, there is a need for a procedure for identifying such documents as genuine or not.

In the past, pressure sensitive adhesives have been utilized to secure the labels to a continuous web during printing. Typically. labels or the like were attached to a silicone release liner by a pressure sensitive adhesive. Customarily, when the pressure sensitive adhesive label was removed from the release liner, the label was attached to another surface by means of the tacky adhesive backing on the label. However, in some instances, it is desirable to be able to have both surfaces of a label or the like, and also the surface of the web from which the label is released, to be clean and non-tacky. Such products are manufactured by the Standard Register Co. and are known as clean release products and are typically used as sew on labels, nameplates, and identification cards.

Previously, such clean release products have been made through the use of so-called releasable or fugitive adhesives. These releasable adhesives exhibit cohesive (internal) failure instead of the usual adhesive/adherend failure exhibited by typical pressure sensitive adhesives. These releasable adhesives are compositions which form relatively weak bonds, but which adhere well to paper and other surfaces. Failure occurs within the releasable adhesive film itself when a layer of a laminate is subjected to peeling forces. This class of adhesives can be formulated to provide a range of cohesive strengths.

When cohesive failure occurs in such releasable adhesives, a thin film of adhesive remains on the back surface of the face sheet, on the face of the backing sheet or both. However, the film does not exhibit tack and has no adverse effect on the appearance or handling characteristics of the product. Moreover, the surface can be readily printed on.

In some instances, it is desirable to have a product which can be imprinted and which has the added function of providing one or more duplicate copies of the printed information. For example, Singer, U.S. Pat. No. 3,383,121, teaches a self-adhesive copy label which is affixed to a backer sheet by means of a pressure sensitive adhesive. Singer utilizes a multilayer structure which includes a self-contained carbonless sheet which produces the duplicate copy when the label is subjected to printing impact forces. However, in the Singer structure, care has to be taken to isolate the carbonless reactants from the pressure sensitive adhesive layer. Moreover, the labels of Singer have a tacky surface after delamination.

Likewise, Lockhart, U.S. Pat. No. 4,277,089, teaches the use of a removable label product which is adhered to a backer sheet through the use of pressure sensitive adhesive. The backer sheet itself comprises a self-contained carbonless product which provides a duplicate copy when the face sheet is subjected to impact printing forces. Like Singer, the peelable label of Lockhart has a tacky surface.

Further, in some instances, it is desirable to form an image or imprint information on a tag, label, or other document which is not visible to a consumer, but which can be made visible upon inspection to determine the genuineness of the article. Accordingly, the need still exists in the art for a clean release product which can provide a latent image of information printed onto a face sheet or label and which product can be readily removed from a laminate construction resulting in both a nontacky top sheet or label and a non-tacky web or backing sheet surface.

SUMMARY OF THE INVENTION

The present invention meets that need by providing a laminate construction in which the face sheet may be imprinted with both legible and/or covert information. The covert information may be duplicated on the underside of the face sheet or on one or more intermediate sheets as well as a backing sheet. The face sheet can then be readily peeled from the construction and be used as a label, tag, form, or the like. The underlying sheets retain the same information as the face sheet. The covert or latent information can be developed at a later time to produce a visible image. All elements of the construction have nontacky surfaces, permitting easy handling and storage.

As used herein, the terms releasable adhesive and fugitive adhesive are used interchangeably and refer to that class of adhesives which form weak cohesive bonds between the surfaces they contact so that bond failure occurs either by cohesive failure within the adhesive layer itself or by adhesive failure at the interface between the adhesive layer and one of the surfaces it contacts. The releasable adhesives are nontacky to the touch when dry. Further, as used herein, the terms latent image and covert image are used interchangeably and refer to images which cannot be seen by the naked eye, but which can be made visible at will by application of a material which is co-reactant with the latent image.

In accordance with one aspect of the invention, a laminate construction is provided comprising a backing sheet, which may be in the form of a continuous web, and a face sheet covering at least a portion of the backing sheet. A releasable adhesive secures a first or lower surface of the face sheet to a first or upper surface of the backing sheet such that the face sheet and backing sheet are readily separable. Preferably, the releasable adhesive covers the entire first surface of the face sheet. In addition to the releasable adhesive there is also positioned between the first two surfaces a first composition which, when subjected to an imaging force, forms a latent image on both of the first surfaces of the face and backing sheets. These latent images may be developed at a later time by separating the face sheet from the backing sheet and contacting the image with a second composition which, when exposed to the first composition, forms a visible image.

Preferably, the first composition is a color former or color developer compound conventional in the carbonless copy art. The first composition is preferably encapsulated, and a plurality of capsules of the first composition are mixed with the releasable adhesive prior to lamination for certain embodiments of the invention. When an imaging force is applied to the face sheet, the capsules of the first composition are ruptured and released in an image pattern. Some of the released composition transfers to the lower (first) surface of the face sheet, while some of the released composition transfers to the first (upper) surface of the backing sheet, and some remains in the adhesive layer. No visible image forms because no corresponding color producer is present.

Additional intermediate layers may also be present in the laminate construction to provide additional copies of the information. Thus, a second backing sheet may underly the first backing sheet and be secured thereto by a releasable adhesive containing the first composition. When an imaging force is applied, latent images will be formed on the lower surface of the face sheet, both surfaces of the first (intermediate) backing sheet, and the upper surface of the second backing sheet.

In another embodiment of the invention, a laminate construction is provided which includes a face sheet having a releasable adhesive securing a first surface thereof to an opaque coating such that the face sheet and opaque coating are readily separable. The opaque coating is supported on a release liner and secured thereto by a pressure sensitive adhesive. The releasable adhesive contains therein a first composition which, when subjected to an imaging force, forms a latent image on the first surface of the face sheet as well as on the opaque coating.

In another embodiment of the invention, a laminate construction is provided which includes a backing sheet and a face sheet covering at least a portion of the backing sheet. A releasable adhesive secures a first surface of the face sheet to a first surface of the backing sheet. In this embodiment, a first composition is contained in the releasable adhesive layer while a second composition, which when combined with the first composition reacts to form a visible image, is coated onto the the first surface of the backing sheet. Preferably, one of the compositions is encapsulated. Upon the application of an imaging force, the capsules of the first composition are ruptured, the compositions combine on the first surface of the backing sheet, and a visible image develops in the area of the imaging force on the backing sheet. However, the image on the lower surface of the face sheet remains latent.

In yet another embodiment of the invention, a laminate construction is provided which includes a backing sheet, a face sheet covering at least a portion of the backing sheet, and a releasable adhesive securing a first surface of the face sheet to a first surface of the backing sheet. The first (lower) surface of the face sheet has a first composition coated thereon which, when subjected to an imaging force, forms a latent image only on the first surface of the face sheet. Again, preferably, the first composition is encapsulated. In a related embodiment, both of the first surfaces of the face and backing sheets are coated with the first composition. When an imaging force is applied, latent images are formed on both surfaces.

In still another embodiment of the invention, a laminate construction os provided which includes a backing sheet, a face sheet covering at least a portion of the backing sheet, and a releasable adhesive securing a first surface of the face sheet to a first surface of the backing sheet. A first composition is present on the first surface of the backing sheet so that upon application of an imaging force to the face sheet, a latent image is formed only on the first surface of the backing sheet.

In yet a further embodiment of the invention, a laminate construction is provided which includes a face sheet having a releasable adhesive securing a first surface thereof to a pressure sensitive adhesive supported on a release liner so that the face sheet is readily separable from the pressure sensitive adhesive. The first surface of the face sheet contains a first composition which, when subjected to an imaging force, forms a latent image on the first surface of the face sheet.

Moreover, in many of the embodiments of the present invention, the laminate construction may also include a layer of pressure sensitive adhesive on the second surface of the backing sheet protected by a release liner or the like. Such a construction is particularly useful when the backing sheet portion of the laminate construction is to be used as a tag or label which can be adhered to a substrate as desired. The face sheet remains nontacky and can be easily handled and stored.

The latent images which are formed with the various embodiments of the present invention may be developed into visible images at a later time by applying a second composition over the area containing the latent image. For example, where the latent image has been formed using a color former composition, the application of a color developer solution will cause the latent image to become visible.

Accordingly, it is an object of the present invention to provide a laminate construction which is secured together by a releasable adhesive and which can be delaminated to provide a clean release, nontacky product. It is a further object of the present invention to provide a laminate construction in which information printed onto the face thereof may be reproduced as a latent image on the lower surface of the face sheet or on one or more layers beneath it. These, and other objects and advantages of the invention, will become apparent from the following detailed description, the accompanying drawings, and the appended claims.

DESCRIPTION OF THE PREFERRED EMBODIMENTS

Figure 1:
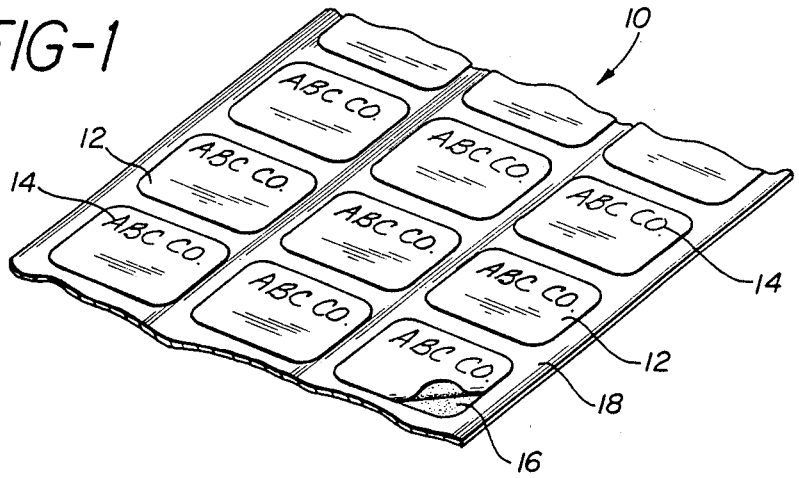
FIG. 1 is a fragmentary perspective view of a laminate construction made in accordance with the present invention.

The laminate construction 10 of the present invention is illustrated in FIG. 1 and includes a face sheet 12 which is typically imprinted with legible indicia 14. As shown, the laminate construction of the present invention may be advantageously formed on a continuous web of backing material 18 so that a multiplicity of individual tags, labels, and the like may be carried on it. The individual face sheets 12 are secured to the backing material 18 by a releasable adhesive 16.

While the invention has been illustrated in terms of a label construction, it will be apparent that it is applicable to many other end uses. For example, full sized documents may be constructed using the laminate construction of the present invention. In such constructions, the die cutting would be on a much larger scale so that each cut out entity would be the size of the document.

Both the backing and face material are typically paper or paper-like material. However, where it is desired to produce identification cards, nameplates, or the like, either or both of the face or backing material may be of thin, flexible plastic or a thin metallic foil or metal-coated plastic. The only requirement is that the face sheet be sufficiently flexible so that when its surface is subjected to an imaging force, the information is transferred to the backing member.

A suitable releasable adhesive material for use in the invention may be any adhesive which has a low cohesive strength, bonds well to paper or plastic, and is nontacky to the touch when dry. The adhesive may be applied to a surface in a fluid state and then converted to a solid by heat, cooling, radiation, or a chemical reaction. Suitable classes of releasable adhesives include water based, hot melt, solvent based, and so-called 100% solids adhesives. Preferred adhesives are water-based polymer latexes or hot melts such as waxes or polymeric resins.

Suitable hot melt adhesives are comprised of waxes, resins and plasticizers and may also contain pigments, dispersion aids and soluble polymers. Suitable waxes include carnauba, Montan, natural and synthetic paraffins and other common waxes known to the art. Suitable resins include hydrocarbon resins and terpine resins. Suitable plasticizers include paraffinic and aromatic hydrocarbon oils, phthalate esters and various synthetic viscous liquids known in the art. Suitable polymers include polyethylenes, polypropylenes, polybutylenes, polystyrenes, polyesters and various copolymers.

An especially preferred class of adhesives may be chosen from blends of polyvinyl acetate and polyethylene latexes or emulsions. Such blends are formulated by varying the ratio of these two emulsions. Such adhesives are commercially available. The peel strength of these blends may be varied by varying the ratios of polyvinyl acetate to polyethylene.

Suitable physical properties for an emulsion type releasable adhesive are; a viscosity of from 3500 to 4500 centipoise at 30 degrees centigrade; a specific gravity of 0.98 to 1.15 grams per cubic centimeter; an oven dry solids content of 43% to 58%; and a pH from 4.5 to 8.5. The adhesive is preferably applied at a rate of from about 3.0 to about 22.0 grams per square meter, and most preferably about 3.0 to about 12.0 grams per square meter, based on dry weight.

The releasable adhesive provides a uniform nonfiber tearing clean release from paper or plastic. Preferred release levels may be in the range of from about 100 to about 500 grams per five centimeters of width, although somewhat higher and lower values are operational. The release test is conducted at 90 degree peel at 1500 centimeters per minute by delaminating the face material from the backing sheet. A releasable adhesive suitable for use in the present invention may generally be identified as one in which cohesive failure occurs as the face sheet is peeled from the backing sheet. Cohesive failure is defined as that which occurs within the layer of adhesive. Adhesive failure is also acceptable. Adhesive failure is defined as failure at the interface between the adhesive and one of the surfaces it contacts.

The latent or covert imaging capability of the present invention is brought about by the positioning of a colorless reactant which, when combined with a second colorless reactant at a later time, reacts to form a colored composition which yields a visible image, in those areas of the surfaces of the face and backing sheets where a latent image had been formed. This may be accomplished a number of ways, described in further detail below, all of which are within the scope of the present invention. The colorless reactants utilized in the practice of the present invention are also found in conventional carbonless copy products. It may be desirable to encapsulate the first reactant composition to prevent undesirable migration of the reactant prior to use.

In some instances it may be desirable to incorporate the colorless latent image material in a non-encapsulated form. This option may be utilized for economic reasons, since encapsulation is a relatively expensive process. When exercising this option, the colorless reactant is trapped as dispersed liquid droplets within the matrix of a film forming binder. This method for isolating liquid droplets within a coating is well known in the art.

Figure 2:
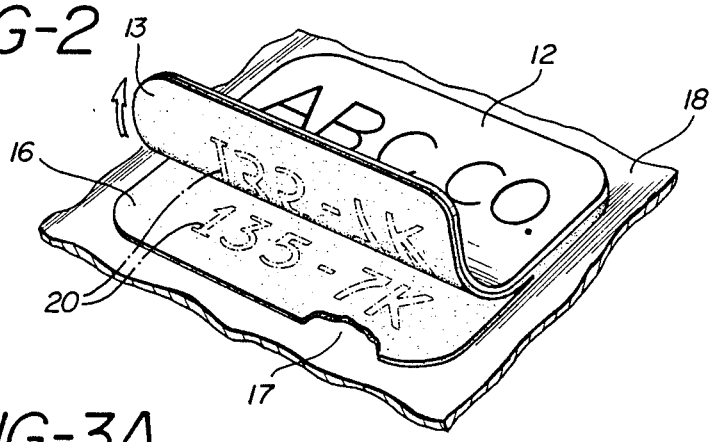
FIG. 2 is a fragmentary plan view showing the top face layer or ply partially peeled back revealing the latent information carried on both the face ply and the backing sheet.

Upon the application of an imaging force to the face sheet, the first colorless composition is released in a latent image pattern to the underside of the face sheet as well as to one or more layers beneath the face sheet. As shown in FIG. 2, additional information can be added to the face sheet in the form of further indicia 20 which may, but need not be visible on the upper surface of face sheet 12. This further indicia 20 appears as a latent image both on the lower surface 13 of face sheet 12 (in mirror image) as well as on the upper surface 17 of backing sheet 18. The indicia may be added to face sheet 12 by hand or mechanically such as by a typewriter or a computer-operated impact printer. If it is not desired that indicia 20 be visible on the upper surface of face sheet 12, then only an imaging force is applied in the absence of ink or other visible printing vehicle.

By way of example only, the labels in FIGS. 1 and 2 are shown to contain information relating to a product serial or other identification number. As shown, the face sheet may be readily peeled away from the construction and used on, or associated with a product as an indicia of genuineness. The backing sheet contains a duplicate copy of the information contained on the face sheet. In some instances, it may be the backing sheet which is secured to the product.

Figure 3A:
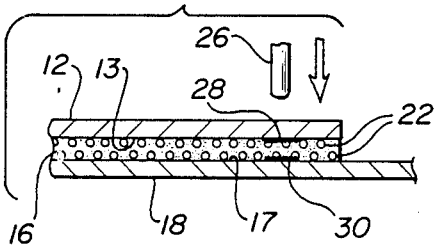
FIG. 3A is a fragmentary sectional view of one embodiment of the present invention showing the formation of latent images.
Figure 3B:
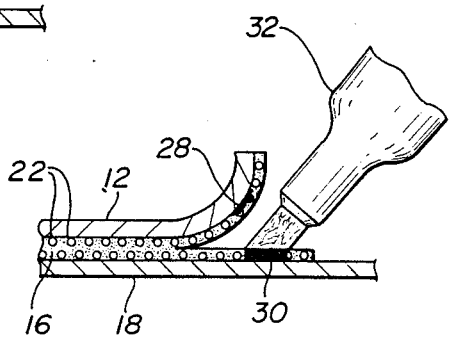
FIG. 3B is a fragmentary sectional view showing the top face layer or ply partially peeled back and a second composition being applied to the latent image on the backing sheet to develop a visible image.

Referring now to FIGS. 3A and 3B, one embodiment of the laminate construction of the present invention is illustrated to show how the latent image information may be developed into a visible image. The laminate construction shown in FIG. 3A may be produced as follows. A first color former composition is dissolved in a suitable solvent and the solution is encapsulated as is known in the art, preferably with water as the continuous phase. The first color forming composition may be any of the several known color formers such as leuco dyes and the like. The capsule slurry may be used as produced with the water phase, or all or a part of the water may be removed.

The microcapsules containing the first color former composition 22 are blended into the releasable adhesive 16. For example, a water-based releasable adhesive such as a blend of emulsions of polyvinyl acetate and polyethylene may be used. If a hot melt adhesive is utilized, the microcapsules may be separated from the water slurry prior to mixing with the adhesive. Typically, such a hot melt adhesive may take the form of a blend of waxes, resins, and plasticizers.

At a coating station, the releasable adhesive and microcapsule blend is coated onto either the lower surface of face sheet 12 or the top surface of backing sheet 18. The two sheets are then brought together such as at the nip between two pressure rolls, causing the adhesive to form a bond between the two sheets. The laminated web is then heated to dry the adhesive (if a water-based adhesive was used) or cooled (if a hot melt adhesive was used).

The continuous web of the laminate is then converted into a continuous backing sheet carrying multiple labels or the like at a die cutting station. At the die cutting station, the laminated web is passed through a conventional label press where printed indicia 14 are repetitively printed onto the top of the continuous face sheet. The face sheet is then die cut into separate labels, and the matrix portion between labels is removed resulting in a construction as illustrated in FIG. 1.

The labels may also be imprinted with other information such as product codes, inventory numbers, and prices, etc. The imaging force, shown schematically as 26, which may produce a visible image or no image at all on the front of the face sheet 12, transfers through that sheet and causes the release of entrapped liquid droplets of composition 22. Some of the color former, or color developer as the case may be, which is released by the imaging force transfers to the upper surface 17 of backing sheet 18 and some transfers to the lower surface 13 of face sheet 12. Some of the released material remains in adhesive layer 16. Latent images 28 and 30 form on the upper surface 17 of backing sheet 18 and lower surface 13 of face sheet 12, respectively.

The label may now be peeled from the backing sheet 18 as shown in FIG. 3B. The use of a releasable adhesive facilitates this removal because of the cohesively weak nature of the adhesive, or because the adhesive bond with either the face or backing sheet is weak. When the latent image forming material is not encapsulated but is contained as dispersed droplets trapped in the matrix of the adhesive layer, it is preferred that separation occur at the interface between the adhesive and face sheet rather than that the adhesive itself fail. The label which is removed is nontacky on its lower surface and can be readily and easily handled. Both the lower surface of the face sheet and the upper surface of the backing sheet contains a duplicate latent copy of the information on the label, and both have nontacky surfaces.

The latent information may be developed and converted into a visible image by applying a color developer solution, or color former solution as the case may be, to either of the surfaces containing the latent images. Suitable color developer compositions, known in the art as CF compositions, include acid clay, phenolic resin, and zinc salicylate. The composition may be dissolved in an alkylated aromatic solvent such as diisopropyl naphthalene or isobutyl biphenyl, or may be a chlorinated paraffin. Suitable color formers are leuco dyes. The color developer solution may be applied by any convenient means such as by aerosol spray, a sponge, or a swab such as a felt-tipped pen 32. On application of the color developer solution to the color former composition (whichever is appropriate), a visible image forms.

Figure 4A:
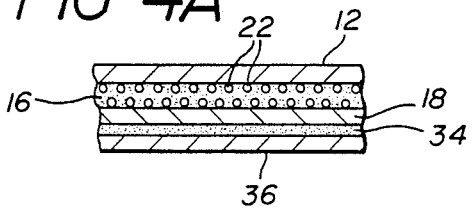
FIGS. 4A–4K are fragmentary sectional views of other embodiments of the present invention.

Referring now to FIGS. 4A–4K, other embodiments of the invention are illustrated using like reference numerals to designate like components of the laminate construction. FIG. 4A shows a construction similar to that shown in FIGS. 3A–3B with the addition of a layer 34 of pressure sensitive adhesive on the lower surface of backing sheet 18. A release liner 36 covers and protects the layer of pressure sensitive until the laminate is applied to a substrate. The pressure sensitive adhesive of FIG. 4A may be used to secure the laminate to a product by peeling off release liner 36 and applying the laminate to a product. The face sheet 12 may be separated from the remainder of the laminate structure leaving behind a nontacky surface on backing sheet 18. Covert information, formed during manufacture of the laminate or later by the user of the label, is carried on the back of face sheet 12 as well as on the upper surface of backing sheet 18.

Figure 4B:
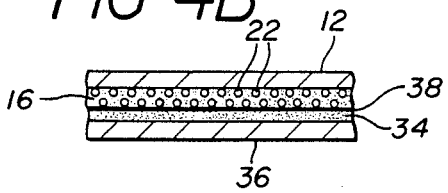

The embodiment of the invention illustrated in FIG. 4B eliminates the need for a backing sheet by substituting therefor an opaque layer 38. Opaque layer 38 may be formed during manufacture of the laminate by first coating releasable adhesive 16, containing latent image material, onto the back of the face sheet 12, dying this coating, and then overcoating layer 16 with an opacifying layer 38 which will provide a contrasting background for the covert information when it is developed into a visible image. The face sheet 12 carrying adhesive layer 16 and opacifying layer 38 is then laminated to a release liner 36 carrying pressure sensitive adhesive coating 34.

Figure 4C:
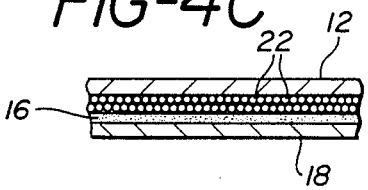
Figure 4D:
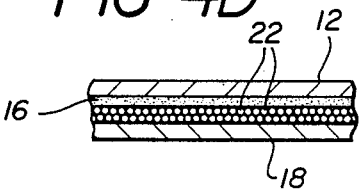

The embodiments of the invention shown in FIGS. 4C and 4D provide for only single covert images because of the arrangement of the laminate layers. In the embodiment of FIG. 4C, a capsular color former 22 is applied as a separate layer before releasable adhesive layer 16 is applied to the lower surface of face sheet 12. When an imaging force is applied, capsules in layer 22 will rupture, an a covert image will be formed on the lower surface of face sheet 12. No image will be formed on backing sheet 18. In the embodiment of FIG. 4D, capsular layer 22 is applied over the upper surface of backing sheet 18, but no capsules are contained within adhesive layer 16. Application of an imaging force will rupture the microcapsules an form a covert image on that surface of backing sheet 18. Because of the positioning of releasable adhesive layer 16, no image will be formed on the lower surface of face sheet 12.

Figure 4E:
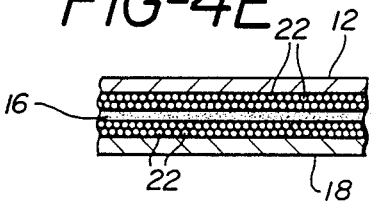

The embodiment of the invention illustrated in FIG. 4E shows yet another variation. In this embodiment of the invention, separate capsular coating layers 22 are applied to both the lower surface of face sheet 12 as well as the upper surface of backing sheet 18. Alternatively, commercially available sheets having a color former already coated thereon may be used for either face sheet 12 or backing sheet 18. Such sheets are commercially available from Appleton Paper Company or the Mead Corporation. Releasable adhesive layer 16 is then used to laminate the two sheets together. Application of an imaging force to face sheet 12 will rupture the microcapsules in each layer and cause the formation of covert images on both the lower surface of face sheet 12 and the upper surface of backing sheet 18.

Figure 4F:
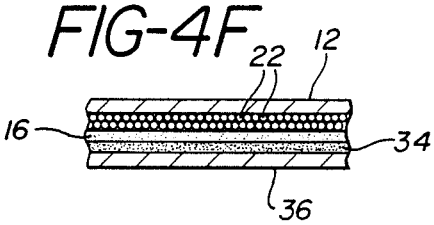

Referring now to the embodiment of the invention illustrated in FIG. 4F, the backing sheet of the embodiment of FIG. 4A and the opacifying layer of the embodiment of FIG. 4B have been eliminated to provide a laminate having a face sheet 12 with a capsular layer 22 coated onto the lower surface thereof. Releasable adhesive layer 16 secures face sheet 12 to the underlying layers of pressure sensitive adhesive 34 and release liner 36. This embodiment of the invention provides a single covert image formed on the lower surface of face sheet 12 when an imaging force is applied.

Figure 4G:
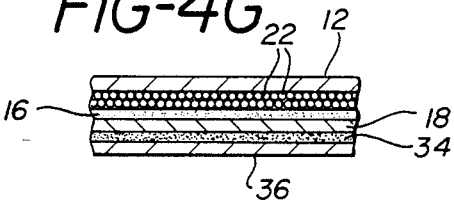
Figure 4H:
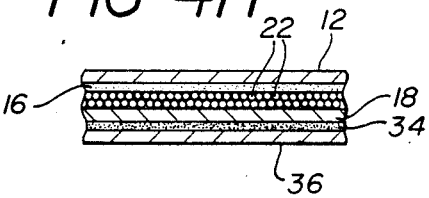

The embodiments of the invention illustrated in FIG. 4G and 4H add additional layers to the laminate constructions of FIGS. 4C and 4D, respectively. That is, both laminates include layers of pressure sensitive adhesive 34 and release liners 36 secured to the lower surface of backing sheets 18. In the embodiment shown in FIG. 4G, a single covert image will be formed on the lower surface of face sheet 12, while in the FIG. 4H embodiment, a single covert image will be formed on the upper surface of backing sheet 18.

Figure 4I:
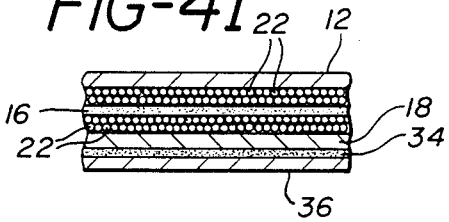

Likewise, the embodiment of the invention shown in FIG. 4I adds a pressure sensitive adhesive layer 34 and a release liner 36 to the laminate construction of FIG. 4E. In the FIG. 4I embodiment, the application of an imaging force to face sheet 12 causes the formation of two covert images, one on the lower surface of face sheet 12 and one on the upper surface of backing sheet 18.

Figure 4J:
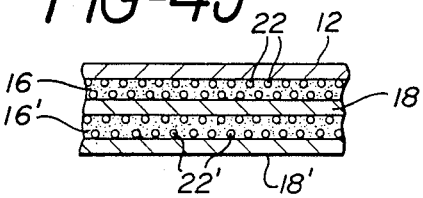

Referring now to FIG. 4J, additional covert images may be formed in a laminate construction in accordance with the present invention by providing a second backing sheet 18' underlying first backing sheet 18. A second layer of releasable adhesive 16', containing capsules 22 therein, secures the second backing sheet 18' to the laminate. Application of an imaging force to the top surface of face sheet 12 will cause the formation of four covert images, on the respective lower surfaces of face sheet 12 and backing sheet 18 and the respective upper surfaces of backing sheets 18 and 18', in the laminate construction.

Figure 4K:
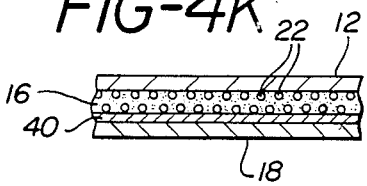

The embodiment of the invention illustrated in FIG. 4K shows the combination of the printing of both visible and covert images by the application of an imaging force to the laminate. In this embodiment, face sheet 12 is coated on its lower surface with a releasable adhesive 16 containing microcapsules 22 of a color former or a color developer. The upper surface of backing sheet 18 is coated with a layer of the opposite color producing composition, and the laminate secured together by the releasable adhesive. Application of an imaging force causes microcapsules 22 containing the one color producing composition to rupture, mixing with the other color producing composition on the upper surface of backing sheet 18 and forming a visible image. At the same time, a covert image is formed on the lower surface of face sheet 12.

The laminate construction of the present invention is useful in the manufacture of secure, genuine labels for products such as clothing, automotive parts, or any other product which is subject to counterfeiting. The laminate produces one or more covert images which can contain information relating to manufacturer's product codes, lot numbers, serial numbers, or other information which will permit an item to be traced to its source. The presence of the latent image on a label made in accordance with the present invention makes the information invisible to counterfeiters, but permits the manufacturer to quickly examine the label and determine whether the label, and thus the product, is genuine.

It is also apparent that the laminate construction of the present invention can be used to manufacture other documents which are subject to counterfeiting such as birth certificates, automobile titles and registrations, checks, or any other document which has value or identifies another product having value. Other modifications within the scope of the present invention will occur to those skilled in the art. The capability of providing duplicate copies of the information can be extended to all of the illustrated embodiments of the invention. Additionally, the capability of providing various combinations of visible and covert images can be provided by the selection and positioning of the layers of the laminate construction. Finally, while all of the laminate constructions are shown with the capsular layers and adhesives coextensive over the entire areas of the laminate, it will be apparent that it may be desirable in some instances to avoid imaging and/or adhesives in certain areas of the construction. For example, if one edge or corner of the face sheet is left unbonded, it is easier to grasp it and peel the face sheet from the laminate construction.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A laminate construction comprising a backing sheet, a face sheet covering at least a portion of said backing sheet, and a releasable adhesive securing a first surface of said face sheet to a first surface of said backing sheet such that said face sheet and backing sheet are readily separable, and a first composition located in said releasable adhesive, or on said first surface of said face sheet, or on said first surface of said backing sheet which comprises a colorless reactant and which, when combined with a second colorless reactant at a later time, reacts to form a colored composition which yields a visible image, said first composition, when subjected to an imaging force, forms a latent image.

2. The laminate construction of claim 1 in which said first composition is encapsulated in a plurality of capsules which rupture upon the application of an impact force on said face sheet.

3. The laminate construction of claim 2 in which said first composition is located in said releasable adhesive and including a second composition on said first surface of said backing sheet, said second composition, when exposed to said first composition, forming a distinctive color image on said first surface of said backing sheet while forming said latent image on said first surface of said face sheet.

4. The laminate construction of claim 1 including a layer of pressure sensitive adhesive on the second surface of the backing sheet.

5. The laminate construction of claim 4 including a release liner overlying said pressure sensitive adhesive layer.

6. The laminate construction of claim 1 including a second backing sheet underlying said first backing sheet, a first surface of said second backing sheet being secured to a second surface of said first backing sheet by a releasable adhesive, said releasable adhesive containing therein a first composition which comprises a colorless reactant and which, when combined with a second colorless composition at a later time, reacts to form a colored composition which yields a visible image, said first composition, when subjected to an imaging force, forms a latent image.

7. A laminate construction comprising a face sheet having a releasable adhesive securing a first surface thereof to an opaque layer such that said face sheet and opaque layer are readily separable, said opaque layer being supported on a release liner and secured thereto by a pressure sensitive adhesive, said releasable adhesive containing therein a first composition which comprises a colorless reactant and which, when combined with a second colorless reactant at a later time, reacts to form a colored composition which yields a visible image, said first composition, when subjected to an imaging force, forms a latent image on said first surface of said face sheet and on said opaque layer.

8. A laminate construction comprising a backing sheet, a face sheet covering at least a portion of said backing sheet, and a releasable adhesive securing a first surface of said face sheet to a first surface of said backing sheet such that said face sheet and backing sheet are readily separable, said first surface of said face sheet having thereon a first composition which comprises a colorless reactant and which, when combined with a second colorless reactant at a later time, reacts to form a colored composition which yields a visible image, said first composition, when subjected to an imaging force, forms a latent image on said first surface of said face sheet.

9. The laminate construction of claim 8 in which said first composition is encapsulated in a plurality of capsules which rupture upon the application of an impact force on said face sheet.

10. The laminate construction of claim 8 in which said first surface of said backing sheet also has thereon a first composition which comprises a colorless reactant and which, when combined with a second colorless reactant at a later time, reacts to form a colored composition which yields a visible image, said first composition, when subjected to an imaging force, forms a latent image on said first surface of said backing sheet.

11. The laminate construction of claim 10 in which said first composition is encapsulated in a plurality of capsules which rupture upon the application of an impact force on said face sheet.

12. The laminate construction of claim 10 including a layer of pressure sensitive adhesive on the second surface of the backing sheet.

13. The laminate construction of claim 12 including a release liner overlying said pressure sensitive adhesive layer.

14. The laminate construction of claim 8 including a layer of pressure sensitive adhesive on the second surface of the backing sheet.

15. The laminate construction of claim 8 including a release liner overlying said pressure sensitive adhesive layer.

16. The laminate construction comprising a face sheet having a releasable adhesive securing a first surface thereof to a pressure sensitive adhesive supported on a release liner such that said face sheet is readily separable from said pressure sensitive adhesive, said first surface of said face sheet containing thereon a first composition which comprises a colorless reactant and which, when combined with a second colorless reactant at a later time, reacts to form a colored composition which yields a visible image, said first composition, when subjected to an imaging force, forms a latent image on said first surface of said face sheet.

17. A laminate construction comprising a backing sheet, a face sheet covering at least a portion of said backing sheet, and a releasable adhesive securing a first surface of said face sheet to a first surface of said backing sheet such that said face sheet and backing sheet are readily separable, said first surface of said backing sheet having thereon a first composition which comprises a colorless reactant and which, when combined with a second colorless reactant at a later time, reacts to form a colored composition which yields a visible image, said first composition, when subjected to an imaging force, forms a latent image on said first surface of said backing sheet.

18. The laminate construction of claim 17 in which said first composition is encapsulated in a plurality of capsules which rupture upon the application of an impact force.

19. The laminate construction of claim 17 including a layer of pressure sensitive adhesive on the second surface of the backing sheet.

20. The laminate construction of claim 19 including a release liner overlying said pressure sensitive adhesive layer.

21. A laminate construction comprising at least three layers, wherein at least one of said layers comprises a face sheet and at least one other of said layers comprises a releasable adhesive securing a first surface of said face sheet to another layer in said laminate construction such that said face sheet is readily separable from said other layer, said laminate construction further including a first composition contained in said releasable adhesive, or on said first surface of said face sheet, or on a surface of said another layer which is in contact with said releasable adhesive, said first composition comprising a colorless reactant and which, when combined with a second colorless reactant at a later time, reacts to form a colored composition which yields a visible image, said first composition, when subjected to an imaging force, forming a latent image.

22. The laminate construction of claim 21 in which at least one other of said layers comprises a backing sheet secured to the first surface of said face sheet by said releasable adhesive.

23. The laminate construction of claim 21 in which at least one other of said layers comprises an opaque material secured to the first surface of said face sheet by said releasable adhesive.

* * * * *